US006237195B1

(12) United States Patent
Shoemaker

(10) Patent No.: US 6,237,195 B1
(45) Date of Patent: May 29, 2001

(54) FIBER MOISTURE CELL FOR HUMIDIFYING COTTON AND METHOD

(76) Inventor: Thomas R. Shoemaker, P.O. Box 54027, Lubbock, TX (US) 79453-4027

( * ) Notice: Subject to any disclaimer, the term of this patent is extended or adjusted under 35 U.S.C. 154(b) by 0 days.

(21) Appl. No.: 09/524,708

(22) Filed: Mar. 14, 2000

(51) Int. Cl.[7] ..... D01B 3/04
(52) U.S. Cl. ..... 19/66 CC; 19/66 R
(58) Field of Search ..... 19/39, 48 R, 65 A, 19/66 CC, 66 R; 68/5 D, 5 E

(56) References Cited

U.S. PATENT DOCUMENTS

| | | | | |
|---|---|---|---|---|
| T975,001 | * | 10/1978 | Mangialardi, Jr. et al. | 19/66 CC |
| 2,019,079 | * | 10/1935 | Herring | 19/66 CC |
| 2,312,557 | * | 3/1943 | Joyce | 19/66 CC |
| 2,747,234 | * | 5/1956 | Speakes et al. | 19/66 CC |
| 2,867,851 | * | 1/1959 | Mitchell et al. | 19/66 CC |
| 3,881,222 | * | 5/1975 | Roberson | 19/66 R |
| 4,021,887 | * | 5/1977 | Jackson | 19/66 R |
| 4,074,546 | * | 2/1978 | Roberson | 19/66 R |
| 4,103,397 | | 8/1978 | Jackson | 19/66 CC |
| 4,140,503 | * | 2/1979 | Vandergriff | 19/66 R |
| 4,253,215 | * | 3/1981 | Mangialardi, Jr. | 19/66 CC |
| 4,253,243 | * | 3/1981 | Whelan | 19/66 CC |
| 4,667,373 | * | 5/1987 | Roder | 19/66 R |
| 4,726,096 | * | 2/1988 | Woods, Jr. | 19/66 CC |
| 4,862,559 | * | 9/1989 | Roder et al. | 19/66 R |
| 4,943,300 | * | 7/1990 | Vinnikov | 19/66 R |
| 5,381,587 | | 1/1995 | Vandergriff | 19/48 R |

* cited by examiner

*Primary Examiner*—John J. Calvert
*Assistant Examiner*—Gary L. Welch

(57) ABSTRACT

Apparatus for humidifying lint cotton in a cotton gin that has a cell arranged for receiving a fiber mass from a lint cleaner and controlling the movement of the fiber over a moist air inlet panel. Warm humid air introduced through an adjustable air inlet panel passes through the moist air inlet panel and, thus, through the cotton under negative pressure raising the moisture content of the fiber mass. The movement of the fiber mass thru the cell is controlled by the amount of warm moist air flowing under pressure through the moist air inlet screen.

2 Claims, 2 Drawing Sheets

FIBER MOISTURE CELL FOR HUMIDIFYING COTTON AND METHOD

BACKGROUND

1. Field of Invention

This invention relates generally to the humidification of fibers, specifically cotton fibers in the form of lint, after the cleaning process and prior to the baling of cotton fibers, particularly to humidification of the cotton fibers by warm moist air under controlled conditions.

2. Description of Prior Art

For years the desirability of humidifying cotton prior to a baling process at cotton gins has been recognized, and many attempts have been made to accomplish this end. There are several reasons for humidifying cotton. Dry cotton is more difficult to press into a bale, it requires 66% more ram pressure to press a dry bale. After baling, dry cotton often breaks the steel wire strapping which contain the bale, necessitating additional labor to repress and replace such broken strapping. Cotton fibers absorb dye in the dyeing process in spinning mills if the moisture content is high.

The first known systematic method of humidifying cotton ahead of the baling press in a cotton gin was that of spraying the batt of cotton with a fine mist of water to which a wetting agent had been added. This method was developed by the U.S. Government's Cotton Ginning Laboratory at Stoneville, Miss.

In recent years, humid air has been applied in the battery condenser of a cotton gin just ahead of the doffing rollers. For example, U.S. Pat. No. 05,381,587 issued Jan. 17, 1995 to A. L. Vandergiff, this patent adds moisture in the battery condenser. The aforementioned apparatus adds moisture in the condenser but has an inherent problem of not being able to add enough moisture and causing expensive repairs to the condenser when moisture collects on the condenser screen. Heat has been added to the screen of the condenser, but with very little results. The aforementioned patent is extremely costly to purchase and has too many moving parts. There is a U.S. Pat. No. 4,103,397 issued Aug. 1, 1978 to S. G. Jackson which employes a tubular grid assembly for adding moisture to cotton fiber at the lint slide. This system is designed for very low capacity cotton gin plants and works marginal at best. All of the aforementioned apparatus are expensive to operate and account for a lot of down time. In U.S. Pat. No. 2,019,079 by Clyde Herring issued Oct. 29, 1935 a system is employed to prevent static electric from forming in cotton fibers while the cotton seed is still within the lint. There is one major problem with this application, when moist air is used in conjunction with machinery designed to clean cotton, there is the inherent nature of the machinery to condense back into water causing major problem with choke ups and down time on the machinery. U.S. Pat. No. 2,312,557 by R. M. Joyce issued Mar. 2, 1943 employes a method for establishing moisture content of fiber by means of injecting moist air directly into the end of the conveying flue, this application has major problems, there is no mention of controlling the problem of moist build up inside of the lint flue. When moist air is applied to a flue and no means to control the flue wall temperature, condensation is a huge problem. This build up will turn loose and choke the battery condenser. With this problem there is loss of production and undue machinery repairs. U.S. Pat. No. 2,747,234 by C. C. Speaks and A. C. Griffin, Jr. dated May 1956 is a planned control system whereby moisture content may be brought up to appropriate levels by adding moist air to machinery that was designated to do another job. With this system, one would have great problems controlling moisture and undue repairs on machinery due to moisture being added. U.S. Patent No. 2,867,851 by O. Mitchell issued Jan. 13, 1959 employes a method to add moisture to seed cotton prior to the seed and lint fiber being separate. This method will cause problems with the gin stand feeder in as much as the feeder has not had time to remove trash from the seed cotton, prior to moisture being added to the fiber. U.S. Pat. No. 3,881,222 by J. H. Roberson issued May 6, 1975 and U.S. Pat. No. 4,074,546 issued Feb. 21, 1978 employes the same method of spraying water and chemicals on raw fibers, as stated before this is just a get by method at best. One cannot expect to spray water on fibers and have the moisture penetration. Both would cause wet spots in cotton fibers along with wetting of machinery. U.S. Pat. No. 4,021,887 by S. G. Jackson issued May 10, 1977 has to do with the control aspect of a cotton gin, again this patent makes no mention of any method to accomplish the end means. File T975,001 dated Oct. 3, 1978 by G. J. Mangialardi, Jr. and A. C. Griffin, Jr. employes a method for handling seed cotton by means of a series of offset belts, this presents a few problems, one is how to control such an apparatus and another is how to justify the cost of such a device. There are inherent problems with belt conveying systems, the largest being the belt will get damp causing the fiber to stick to the belt which will cause choke ups and down time. U.S. Pat. No. 4,140,503 by A. L. vandergriff issued Feb. 20, 1979 uses a battery condenser to add moisture to cotton. This prior art has two large problems, one being the inability to control condensation and the other being limited exposure time to moisture. When moist air is applied to cold steel, moisture forms in the state of condensation resulting in choke ups and down time. U.S. Pat. No. 4,253,215 by G. J. Mangialardi, Jr. is a control schematic to allow the control of cotton flow into a lint cleaner. There is no mention of any moisture being added or the control of any such device. U.S. Pat. No. 4,253,243 by P. L. Whelan dated Mar. 3, 1981 employes a control method of sensing moisture and controlling a hot air supply. This patent does not mention anything about adding moisture to cotton fibers. U.S. Pat. No. 4,726,096 by c. Woods, Jr. issued Feb. 23, 1988 employes yet another method of praying water onto cotton fibers prior to the baling process, that method is a method that has several drawbacks to its use one being water will run off of cotton in its raw state, another being water will run down the lint slide causing cotton to stick to the metal and yet another is the inability to obtain enough moisture from this system. U.S. Pat. No. 4,862,559 dated Sep. 5, 1989 and U.S. Pat. No. 4,667,373 dated May 26, 1987 by E. A. Roder and G. J. Napper use live steam to inject into the bale of fiber while the fiber is located in the press to bring the level of moisture up in a given fiber. This system is very slow and one cannot get the moisture level up in cotton fibers due to the density of cotton fibers after the baling process. This prior art also mentions the use of high pressure steam in the process, this would cause a safety problem with special license and special insurance requirements deeming this application undesirable. U.S. Pat. No. 4,943,300 by L. Vinnikov dated Jul. 24, 1990 sets forth a mathematical formula for time exposure of cotton fiber to moist air in order to achieve a predetermined level of moisture, but makes no mention of how to achieve this end. All of the aforementioned apparatus are expensive to operate and account for a lot of down time. The end results are the same, when operating cost exceed results, operators will shut down their moisture systems due to high maintenance cost, down time and low absorption of moisture in the cotton fibers.

All of the aforementioned apparatus have been based on the same process of applying moisture to one side of the lint batt and hoped that it would penetrate throughout the batt, but this does not happen.

The problem with the aforementioned patents is that each one tried to add moisture to lint fiber after all lint was combined into a batt near the final process of the gin plant.

All of the aforementioned patents were state of the art at the time, but with the advancement of high capacity gin plants, state of the art controls and a more advanced understanding of cotton fibers and their need for moisture, there is a need for a new method of applying moisture to cotton fibers.

SUMMARY

In accordance with the present invention, a fiber mass is passed between two moist air screens, the movement is impeded by the addition of warm moist air, causing the fiber mass to absorb said moisture.

OBJECTS AND ADVANTAGES

It is an object of the present invention to humidify ginned cotton prior to the battery condenser, prior to the baling press and prior to the lint flue, without effecting the operation of the aforementioned apparatus and without the problems of the aforementioned devises.

It is another object of the invention to conserve our natural resources by providing to the ginning industry a system that will be energy efficient, cost less initially, require no down time, no moving parts and achieve its intended expectation.

A further object of this invention is to provide an area wherein fiber is captured and moisture introduced under pressure on one or both sides of the fiber batt.

A further object of this invention is to achieve the aforementioned with an apparatus that is sturdy, compact, durable, simple, safe, efficient, ecologically compatible, and reliable yet inexpensive and easy to manufacture, install, operate and maintain with no moving parts. Other objects are to achieve a method that is rapid, versatile, efficient and does not require highly skilled people to institute and operate.

An advantage of this invention over prior art is, the ability to add moisture to the fiber at each lint cleaner discharge.

An advantage of this invention over prior art is, no moving parts, no upkeep and no down time.

The specific nature of the invention, as well as other objects, uses and advantages thereof, will clearly appear from the following description and from the accompanying drawings. The different views of which are not necessarily scale drawings.

DRAWING FIGURES

Figure 1:
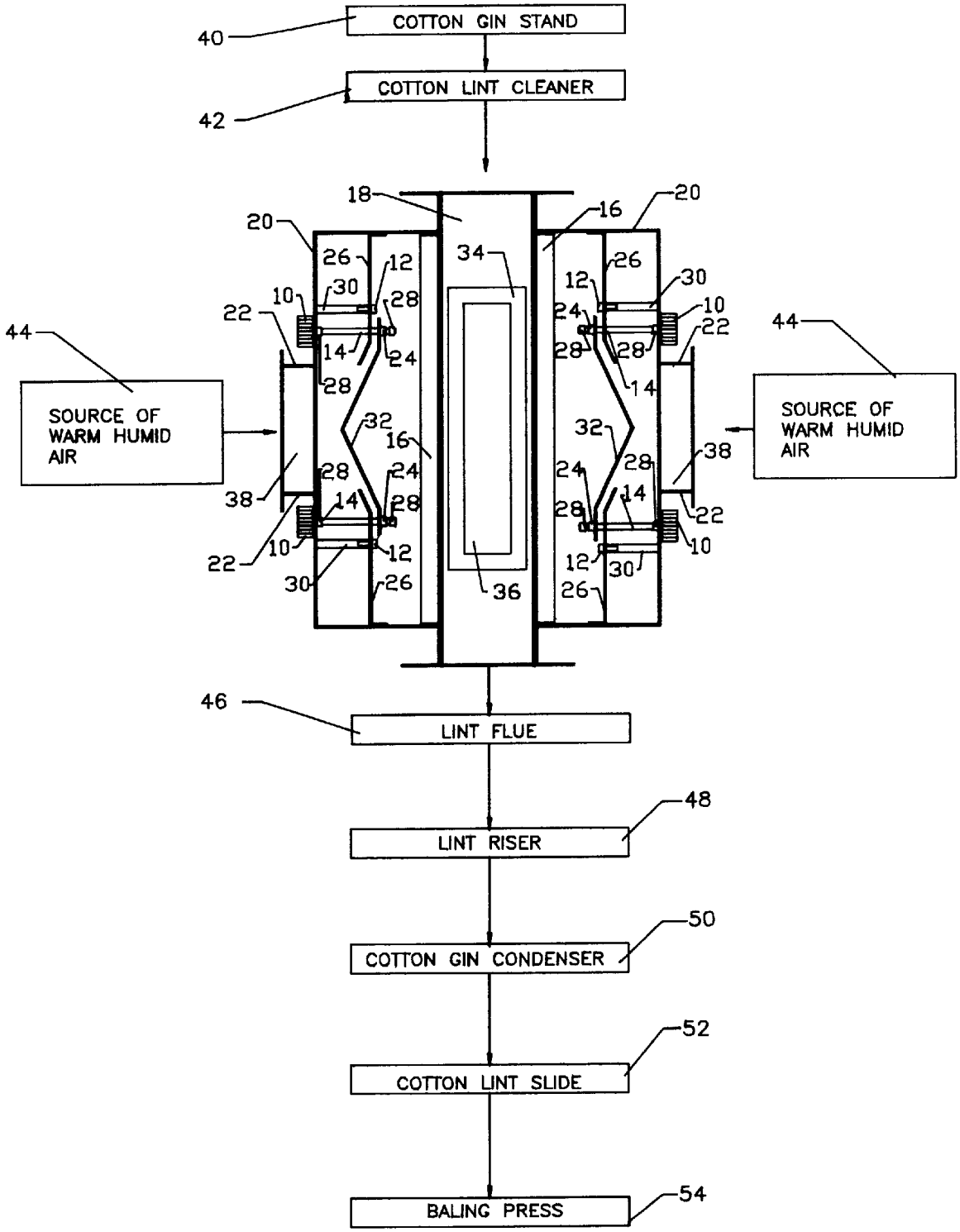
FIG. 1 is a drawing with schematic representation of some elements of an embodiment of this invention.
Figure 2:
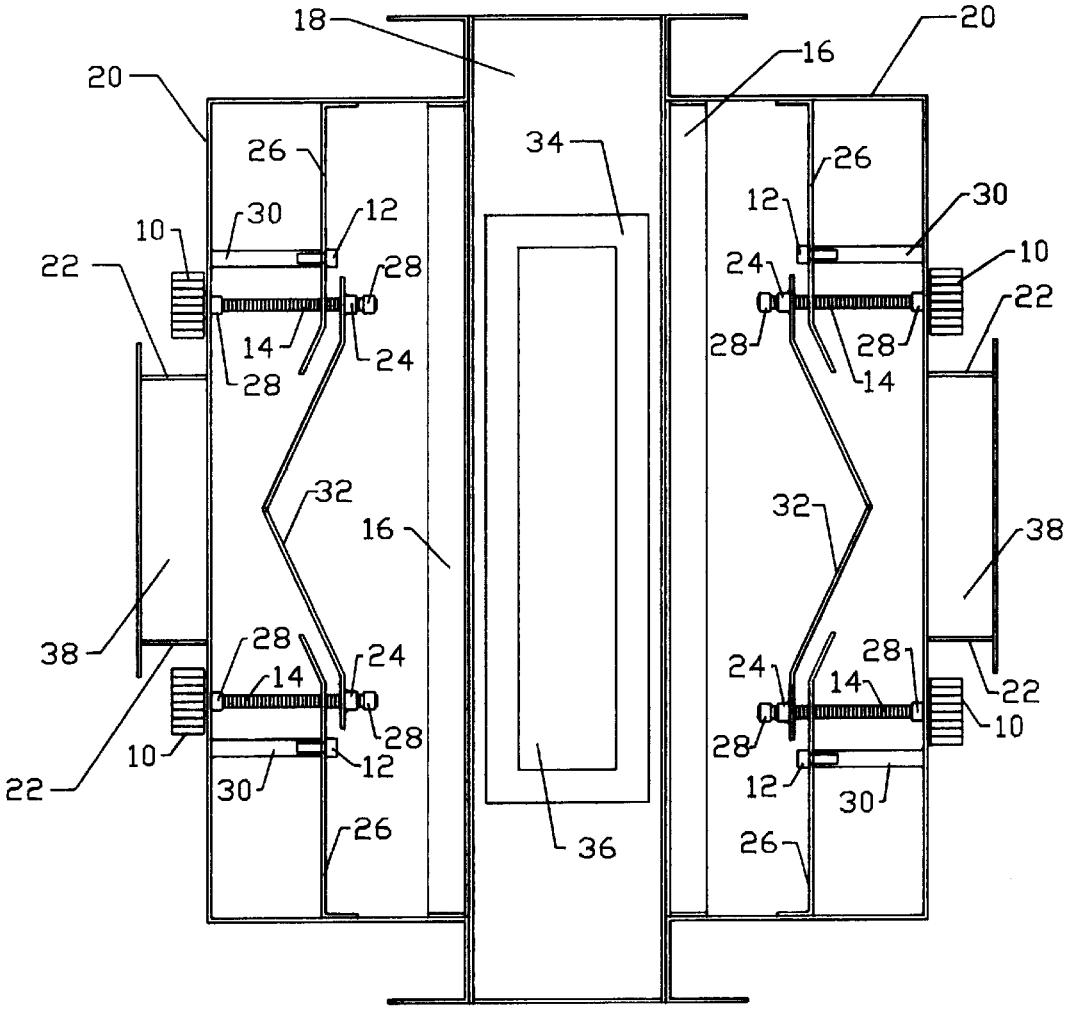
FIG. 2 is a enlarged portion of FIG. 1 showing the details of the fiber moisture chamber.
Figure 3:
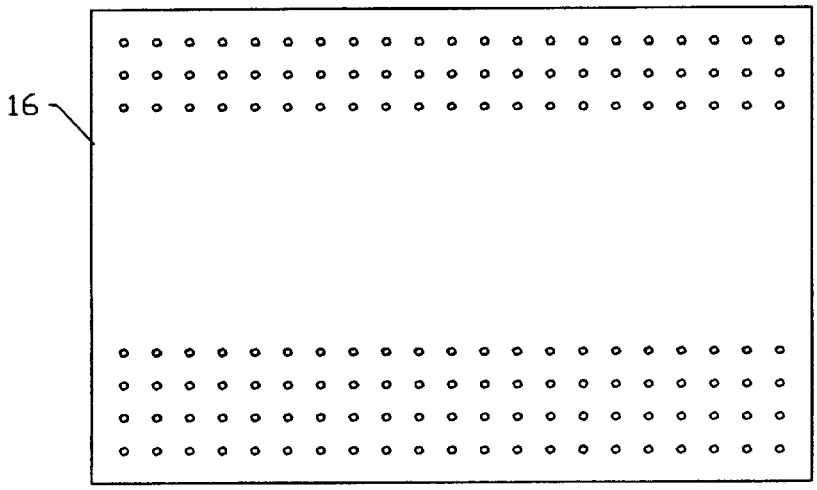
FIG. 3 is a stationary air panel showing a plurality of openings on top and bottom of the panel.

As an aid to correlating the terms of the claims to the exemplary drawing(s), the following catalog of elements are provided:

10 knob
12 fastener
14 air adjust rod
16 moist air screen
18 end support
20 housing
24 weldnut
26 rigid air inlet panel
28 locknut
30 spacer
32 adjustable air inlet panel
34 window frame
36 window glass
38 inlet flange, short side
40 gin stand
42 lint cleaner
44 source of warm humid air
46 lint flue
48 lint riser
50 cotton gin condenser
52 lint slide
54 baling press

DESCRIPTION OF THE PREFERRED EMBODIMENTS(S)

Referring first, more particularly, to FIG. 1 of the wings within a cotton gin plant, there may be seen a layout equipment and travel of lint cotton in a cotton gin along with a fiber moisture cell.

Other equipment associated with the fiber moisture cell will be a source of warm humid air 44. The warm humid air source 44 must deliver a set quantity of air at the desired temperature and humidity. Units of this nature are well known to the art and therefore not further described.

The cotton gin stand 40 will supply the lint cleaner 42 with lint cotton. The gin stand 40 is a well known cotton gin structure that separates the lint from the seed. The lint cleaner 42 is a well known machine that cleans trash from lint cotton.

The lint cleaner 42 feeds cotton fiber into a lint flue 46, the lint flue feeds cotton into the lint riser 48, the lint riser feeds cotton into the battery condenser 50, the battery condenser feeds cotton onto the lint slide 52 which feeds cotton into the baling press 54.

Those skilled in the art will recognize that the elements and their relationship as described to this point to be old and well known in the cotton ginning art.

The lint cleaner 42 will discharge cotton fibers into the fiber moisture cell as shown in FIG. 1, fibers being discharged will flow between the stationary moist air screens 16, which will allow moist air to penetrate the fibers, then said fibers will be discharged into the lint flue 46.

A fiber moisture cell contains several parts. A rigid air inlet panel 26, which is basically a rectangular plate having one edge attached to a housing 20 and the other edge forms an angle of about 45 degrees and is secured to the housing 20 by means of a spacer 30 and a fastener 12. This rigid air inlet panel 26 is used with the adjustable air inlet panel 32 to obtain the correct amount of moist air by means of the adjusting knob 10 and air adjust rod 14. To obtain the correct moist air flow, the adjust knob 10 is turned clockwise for less air and counterclockwise for more air. By turning knob 10, the adjustable air inlet panel 32 is open or closed on rigid air inlet panel 26. Air is forced to flow through the opening between the two panels. This moist air can be balanced to have more flowing to the top or more flowing to the bottom of the moist air screen 16. The air adjustment rod 14 is secured in place by locknut 28 and weldnut 24. This air adjustment is required any time the source of warm humid air 44 is changed. This adjustment is made by observing the flow of lint cotton thru window 36.

Moist air and fiber is separated by a moist inlet screen 16 which is a rectangle shaped panel with a series of openings punched on upper and lower portion. These holes are so arranged as to prevent back flow and to provide self cleaning. The moist air inlet screen 16 is secured to the housing 20 in order to make a rigid panel. The moist air inlet screen 16 is so designed to allow moist air exiting the panel to be at a velocity great enough not to allow cotton fibers to adhere to the screens.

The end support 18 is a rectangle with window frame 34 and window glass 36 manufactured rigid enough to support the weight of a fiber moisture cell.

Moist air enters the fiber moisture cell through a rectangle opening formed by 22 and 38 located on each side.

The embodiment shown and described above is only exemplary. I do not claim to have invented all the parts, elements or steps described various modifications can be made in the construction, material, arrangement, and operation, and still be within the scope of my invention.

The restrictive description and drawings of the specific example above do not point out what an infringement of this patent application would be, but will allow one skilled in the art to make and use the invention. The limits of the invention and the bounds of the patent protection are measured by and defined in the following claims.

What is claimed is:

1. A method for applying moisture to fiber on a hygroscopic level, comprising the steps of:

a. providing a conveying path for said fiber to pass through opposing stationary moist air screens, and b. controlling said fiber flow by means of moist air blown horizontal to a flow of said fiber, and c. controlling this said horizontal moist air flow by means of said stationary moist air screens with a predetermined plurality of outlets, and d. further controlling said moist air flow by a opening between the rigid air inlet panel and the adjustable air inlet panel, and e. passing warm moist air through said moist air screens where by said fiber has increased substantially in hygroscopic moisture.

2. A fiber moisture cell, comprising:

a. a rigid air inlet panel having one edge attached to a housing and the other edge forms an angle of about 45 degrees to the flow of fiber and secured to the housing by means of a spacer and a fastener, and b. an adjustable air inlet panel having both ends attached to weldnuts that are threaded on a air adjust rod on either side of said adjustable air inlet, and c. stationary moist air screen with a plurality of outlets on the upper and lower portions so as to prevent back flow and to provide self cleaning, whereby moist air can be adjusted to have equipoise flow to the top or to the bottom of said stationary moist air screen.

* * * * *